United States Patent [19]

Conard

[11] 4,160,495

[45] Jul. 10, 1979

[54] SUITCASE WITH TRANSPORTING RIMS

[76] Inventor: Donald D. Conard, 900 N. Point St., San Francisco, Calif. 94109

[21] Appl. No.: 878,364

[22] Filed: Feb. 16, 1978

[51] Int. Cl.[2] ..... A45C 5/14

[52] U.S. Cl. ..... 190/18 A; 280/47.26

[58] Field of Search ..... 190/18 R, 18 A; 280/205, 208, 47.26, 62

[56] References Cited

U.S. PATENT DOCUMENTS

| | | | |
|---|---|---|---|
| 311,919 | 2/1885 | Redmond | 190/18 R |
| 1,701,953 | 2/1929 | Lowe | 190/18 R |
| 3,163,268 | 12/1964 | Leavell | 190/18 A |

*Primary Examiner*—Ro E. Hart

*Attorney, Agent, or Firm*—Townsend and Townsend

[57] ABSTRACT

A suitcase surrounded by paired circular raceways forming an endless track is disclosed. Into each of these raceways there is mounted a complementary revolving rim rotating upon bearings placed at intervals around the raceway. The rim, preferably taking the form of a circular tube, surrounds the suitcase. This rim forms the points of rotating transport over the ground. In operation, the suitcase is propelled by a handle which protrudes from the end wall of the suitcase between the raceways, yet permits convenient opening of the suitcase. The suitcase, because of its attachment at the handle, does not rotate. The tubes within the raceways do rotate and provide continuously revolving contact points with the ground.

5 Claims, 3 Drawing Figures

SUITCASE WITH TRANSPORTING RIMS

This invention relates to a suitcase mounted for self-supporting movement over the ground.

SUMMARY OF THE PRIOR ART

Suitcases mounted for self-supporting travel over the ground are known. Heretofore, however, such suitcases have had severe limitations.

First, it is most common for such suitcases to be provided with very small peripheral wheels. Such wheels, while having the advantage of not substantially interfering with the bulk of the suitcase, are not capable of rotating over any kind of a barrier. Thus, where the suitcase comes up against a step, an enlarged crack in the pavement, or other common obstacle, the wheels frequently impact the barrier and do not pass over it. The result is the wheels are frequently dislodged, damaged, or the like. Such suitcases have to be simply lifted over any kind of a barrier which they encounter.

Substantially larger wheels have been mounted to suitcases. These wheels have at least two severe disadvantages. Larger wheels frequently add to the overall bulk and weight of the suitcase. This addition of weight and bulk destroys the desired light weight and compactness of the suitcase. Moreover, where larger wheels are recessed into the conventional profile of a suitcase, they take up space interior of the suitcase. Not only is the interior of the suitcase reduced in space available for packing, but the wheels frequently interrupt what would otherwise be a regular interior contour of a suitcase. In such interruption, the overall capacity of the interior of the suitcase is reduced.

Additionally, circular suitcases have been provided. These circular suitcases are rotated about a central pivot as they are propelled over the ground. These suitcases subject their contents to periodic rotation. As the suitcase moves over the ground, it is impossible to maintain the goods therein in a "rightside up" disposition. Further, such suitcases are inevitably eccentrically loaded. The circumstance of packing such a suitcase for travel makes the packing of the suitcase without eccentric loading all but impossible. Consequently, such suitcases eccentrically rotate; they will not readily accept a stationary location but will roll so that their eccentric point of gravity is at the lowest possible level of gravitation.

Finally circular suitcases have been provided which have a single large circular rim which rotates upon the ground relative to the suitcase which remains stable. However, these suitcases, because of the large single rim, have handles which prevent convenient opening of the suitcase. These handles are cooperatively attached to two rigid or flexible connecting members, each of which is attached to one side of the suitcase. Thus, the handle must be disconnected from the suitcase or disassembled in some fashion in order for the suitcase to be opened. The subject invention, on the other hand, provides not only a suitcase which remains stable when rolling over the ground, but also a suitcase constructed in such a manner as to provide convenient opening and easy access to the entire interior portion of the suitcase.

SUMMARY OF THE INVENTION

A suitcase surrounded by paired circular raceways forming an endless track is disclosed. Into each of these raceways there is mounted a complementary revolving rim rotating upon bearings placed at intervals around the raceway. The rim, preferably taking the form of a circular tube, surrounds the suitcase. This rim forms the points of rotating transport over the ground. In operation, the suitcase is propelled by a handle which protrudes from the end wall of the suitcase between the raceways, yet permits convenient opening of the suitcase. The suitcase, because of its attachment at the handle, does not rotate. The tubes within the raceways do rotate and provide continuously revolving contact points with the ground.

OBJECTS AND ADVANTAGES OF THE INVENTION

It is an object of this invention to provide a large eccentric rim mounted to circular raceways on a suitcase. According to this aspect of the invention, a suitcase is provided with circular raceways. Into these raceways there is mounted a circular and revolving rim. By propelling the suitcase at a mounted handle, transport of the suitcase readily occurs.

An advantage of this aspect of the invention is that the suitcase easily passes over the normally encountered barriers of sidewalk gutters, stairs and the like.

Yet another advantage of this invention is that the suitcase does not have to be lifted over many of the commonly encountered barriers. Rather, the large rotating surface provided by the rotating rim enables relatively easy passage over gutters, steps and the like.

Yet a further advantage of this invention is that the impacting of small wheels with barriers is avoided. Wheel damage and resultant shock to the suitcase and contents is reduced.

Yet another object of this invention is to mount circular raceways to the circular profile of a suitcase. The resultant rims conform precisely to the circular shape of the suitcase.

An advantage of this aspect of the invention is that the transporting rims do not occupy substantial portions of the interior of the suitcase. Space loss interior of the suitcase is non-existent. The storage capacity of the disclosed suitcase relative to conventional circular suitcases is unchanged.

Yet another object of this invention is to disclose a circular suitcase for rolling transport over the ground, which does not in itself rotate. According to this aspect, a handle is mounted to the circular suitcase. When the suitcase is pushed at the handle, rims mounted interior of the raceways do the rotating required for transport. The suitcase does not rotate.

An advantage of this aspect of the invention is that the suitcase and its contents are not subject to periodic rotation. Rather, the transporting rims are the only elements that rotate.

Yet another advantage of this aspect of the invention is that the suitcase does not have to be packed to avoid eccentric loading. Propulsion of the suitcase over the ground is smooth and substantially without difficulty.

Other objects, features and advantages of this invention will become more apparent after referring to the following specification and attached drawings in which.

Figure 1:
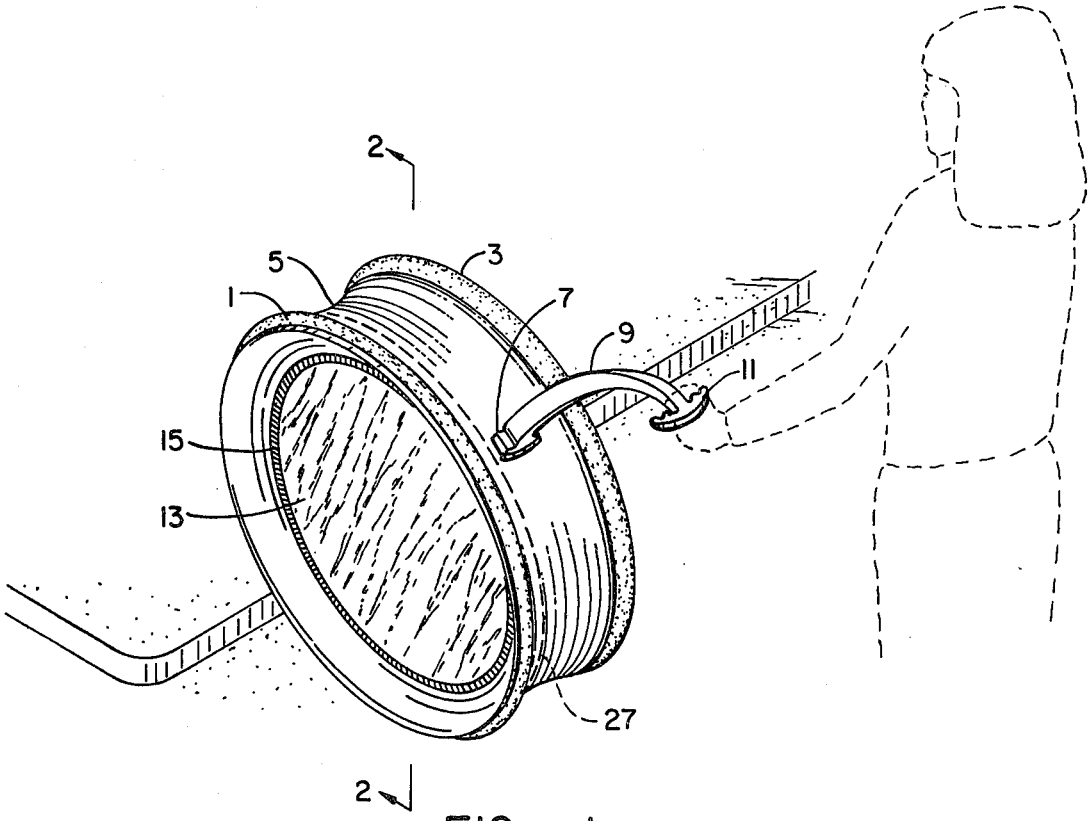
FIG. 1 is a perspective view of the preferred embodiment of the subject invention in use.
Figure 2:
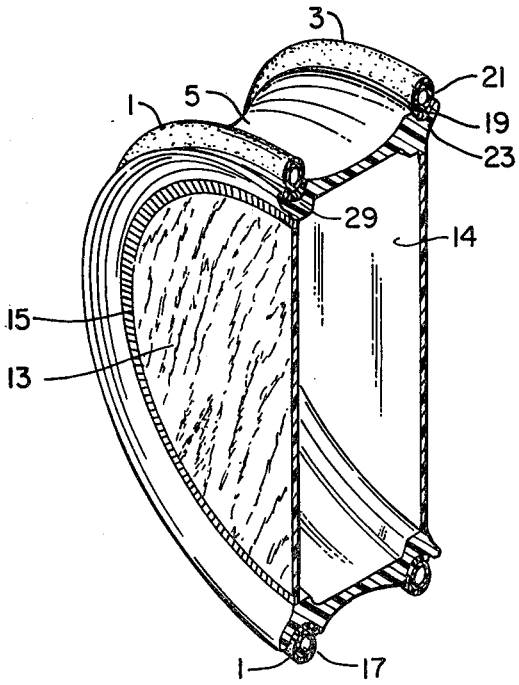
FIG. 2 is a cross section in perspective of the preferred embodiment of the subject invention; and, FIG. 3 is an enlargement of a portion of the cross section showing the rim, raceways and bearings.
Figure 3:
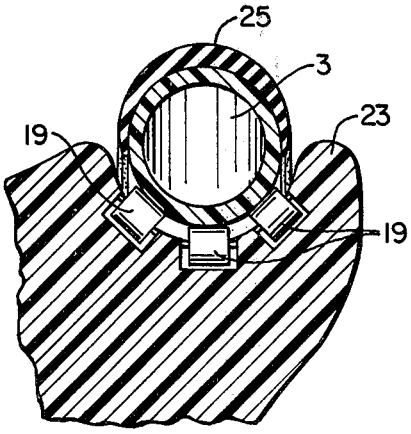

The subject invention is a suitcase. It is composed of two flat side walls 13 and 14 and one end wall 5 cooperatively joined together. In the preferred embodiment, each of the side walls is circular or disc-like in shape and the end wall, when connected to the two side walls, is cylindrical in shape. The side walls are composed of vinyl, leather, or other flexible luggage material. The end wall is composed of a rigid material suitable for use with luggage, preferably molded plastic. An enclosed, flat cylindrical suitcase results.

In the preferred embodiment, the suitcase opens by means of a zipper 15 and actuating zipper car for opening and closing a lid or flap located in one of the side members of the suitcase. The zipper runs close to the periphery of the side wall, almost around the entire side wall, such that when the zipper is open, the side of the luggage folds back and provides convenient acess to the entire interior portion of the suitcase.

Alternately the suitcase opening can be medially placed between the two side walls. Such an opening 27 may either be by zipper or more conventional suitcase opening techniques.

Two or more circular raceways 23 and 29, each forming an endless track, are mounted on the end wall of the suitcase. Preferably, one raceway is mounted near each edge of the end wall, surrounding said end wall. The interior side of the raceway which is mounted onto the end wall is flat, and the exterior of the raceway is in the shape of a chord of a circle. In the preferred embodiment, the end wall and raceways are composed of one piece of molded plastic, and the end wall between the raceways is recessed.

At intervals in the exterior surface of the raceways are placed means for permitting relative rotation. In the preferred embodiment, three rotating bearings 19 are placed across the chord of the raceway at each interval.

In the exterior of each raceway on the bearing is placed a complementary rim 1 or 3, forming an endless track and composed of a rigid material usable in luggage construction. In the preferred embodiment, the rim 1 or 3 is in the form of a circular tube made of high impact plastic. Also, the exterior of each tube, which contacts the ground as the tube is rotated, is covered with a resilient plastic material 17 or 25, acting as a tread. The rim rotates upon the bearings, conforms precisely to the circular shape of the raceway, and remains in the raceway even while rotating upon the bearings.

Attached to the end wall of the suitcase is a handle 9. In the preferred embodiment, this handle is attached to said end wall by a detent mechanism 7 which locks the handle into an open position or into a closed position.

When the handle is locked into the open position, the suitcase can be pushed or pulled across the ground. The rims roll across the ground, moving relative to the suitcase which remains in stable position. Thus, the contents of the suitcase are not tumbled about by the movement of the suitcase, nor does the handle interfere with convenient opening of the suitcase, either on the side, as in the preferred embodiment, or alternately, along the end wall.

Preferably, the handle itself is an arcuate shape which conforms to the cylindrical shape of the end wall. Thus, when the handle is locked into a closed position, it conforms to the shape of the end wall of the suitcase; the suitcase becomes more compact and can be easily stored.

Thus, it can be seen that the subject invention provides a convenient means of transporting a suitcase across the ground while insuring that the suitcase itself remains stable and contents thereof ar not tumbled about. Furthermore, the handle provides a convenient point from which to roll the suitcase, but does not interfere with opening or closing the suitcase.

What is claimed is:

1. A suitcase for rolling movement over the ground comprising: a suitcase having side walls and end wall cooperatively joined together to form an enclosed article receiving volume; at least first and second raceways mounted to the end wall of said suitcase and extending around said suitcase in an endless track; at least first and second rims forming complementary endless tracks for reception into said first and second raceways; means for permitting relative rotation between said rims and said raceways to permit rolling movement of said suitcase over said ground.

2. The suitcase of claim 1 and wherein said suitcase has attached between said rims a handle for propelling said suitcase.

3. The suitcase of claim 1 and wherein said enclosed article receiving volume forms an enclosed flat cylindrical volume.

4. The suitcase of claim 1 and wherein said rims at the periphery thereof include resilient treads for contact with said ground.

5. The suitcase of claim 1 and wherein said enclosed article receiving volume has an access lid in a disc-shaped end wall for placing articles within said suitcase, and means for selectively opening and closing said lid to place articles interior of said suitcase.

* * * * *